US006935289B2

(12) United States Patent
Nakahira

(10) Patent No.: US 6,935,289 B2
(45) Date of Patent: Aug. 30, 2005

(54) VALVE DRIVE SYSTEM FOR FOUR-STROKE ENGINE

(75) Inventor: Yasuyuki Nakahira, Iwata (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 10/947,102

(22) Filed: Sep. 22, 2004

(65) Prior Publication Data

US 2005/0061274 A1 Mar. 24, 2005

(30) Foreign Application Priority Data

Sep. 22, 2003 (JP) ..... 2003-330046

(51) Int. Cl.[7] ..... F01L 1/34

(52) U.S. Cl. ..... 123/90.16; 123/90.21; 123/90.18; 123/90.2; 123/90.39; 123/90.44; 74/569

(58) Field of Search ..... 123/90.16, 90.18, 123/90.2, 90.21

(56) References Cited

U.S. PATENT DOCUMENTS 3,878,822 A * 4/1975 Beal ..... 123/90.16
4,182,289 A * 1/1980 Nakajima et al. ..... 123/90.16
4,499,870 A * 2/1985 Aoyama ..... 123/198 F
4,516,542 A * 5/1985 Aoyoma et al. ..... 123/90.16
5,111,781 A * 5/1992 Kaku et al. ..... 123/90.16
6,748,913 B2 * 6/2004 Nakayama ..... 123/90.21

FOREIGN PATENT DOCUMENTS

JP 11-166449 6/1999
JP 2001-193426 7/2001

* cited by examiner

*Primary Examiner*—Thomas Denion
*Assistant Examiner*—Kyle M. Riddle
(74) *Attorney, Agent, or Firm*—Knobbe, Martens, Olson & Bear, LLP

(57) ABSTRACT

A valve drive system capable of reducing the friction resistance of rocker arms and facilitating replacement work of tappet-clearance adjusting shims. The valve drive system can comprise a rocker arm that is slidable between a first position at which the pushing portion engages the shim and a second position at which the pushing portion is disengaged from the shim, and held in the first position through a spring.

12 Claims, 9 Drawing Sheets

VALVE DRIVE SYSTEM FOR FOUR-STROKE ENGINE

PRIORITY INFORMATION

The present application is based on and claims priority under 35 U.S.C. § 119 to Japanese Patent Application No. 2003-330046, filed on Sep. 22, 2003, the entire contents of which are expressly incorporated by reference herein.

BACKGROUND OF THE INVENTIONS

1. Field of the Inventions

The present inventions generally relate to a valve drive system for a four-stroke engine in which rollers in rolling contact with an intake cam and an exhaust cam are incorporated in rocker arms for opening and closing an intake and an exhaust valve.

2. Description of the Related Art

The so-called single over-head cam "SOHC" type four-stroke engine in which an intake valve and an exhaust valve are opened or closed through one camshaft, typically includes an intake rocker arm for transmitting the movement of an intake cam to the intake valve and an exhaust rocker arm for transmitting the movement of an exhaust cam to the exhaust valve.

The intake and exhaust rocker arms are supported on rocker shafts for rocking movement, respectively. The rocker shafts are disposed parallel to each other and are disposed on both sides of the camshaft. The intake rocker arm extends from the intake cam, across the rocker shaft, toward the valve stem of the intake valve. Similarly, the exhaust rocker arm extends from the exhaust cam, across the rocker shaft, toward the valve stem of the exhaust valve.

In such engines, it has been known to incorporate rollers at the ends of the rockers facing the respective cam. The rollers are in rolling contact with the intake cam and the exhaust cam, which reduces the frictional resistance produced in the contact portion of the rockers with the respective cams (for example, see Japanese Patent Application No. 2001-193426).

Other systems for such four-stroke engines have included tappet-clearance adjusting shims placed between the rocker arms and the respective valve stems for reducing friction. In this type of engine, the intake and exhaust rocker arms are slidable in the axial direction of the rocker shafts, and the shims can be removed when these rocker arms are displaced to the sides of the valve stems (see, Japanese Patent Application No. Hei 11-166449).

SUMMARY OF THE INVENTION

In the four-stroke engine disclosed in Japanese Patent Application No. 2001-193426, a rocker arm is provided with an adjusting screw to be in abutment against the top end of the valve stem. Therefore, turning the adjusting screw allows adjustment of the tappet clearance, facilitating the adjusting work.

However, according to Japanese Patent Application No. 2001-193426, since an adjusting screw and a lock nut for securing the screw are mounted on the rocker arm, the construction of the rocker arm is complicated, resulting in a higher cost. In addition, the rocker arm is heavier and larger, which is a factor limiting engine speed.

Also, in the four-stroke engine disclosed in Japanese Patent Application No. Hei 11-166449, since the rocker arms can be displaced to the sides of the valve stems, replacement work of shims can be performed without removing the camshaft or without using special tools by which intake and exhaust valves are held in the state of being lifted highest.

In the case of this four-stroke engine, the rocker arm is formed, at one end, with a slipper, and the slipper is in contact with intake and exhaust cams on the camshaft for sliding movement. However, the slipper type rocker arm has a large frictional resistance produced in the contact portions with the intake and exhaust cams compared with a roller type rocker arm, raising a problem of early wear of the slipper and the intake and exhaust cams particularly when proper lubrication control is neglected.

As described above, either of the four-stroke engines disclosing the foregoing two patent documents has advantages and disadvantages in the construction of the valve drive mechanism for driving its intake and exhaust valves and an four-stroke engine has yet to be found in which the frictional resistance produced in the contact portions of the rocker arms with the intake and exhaust cams is kept to a small value while the rocker arms are slidable.

In view of the foregoing, an object of this invention is to provide a valve drive system for a four-stroke engine capable of suppressing the frictional resistance produced in the contact portions of rocker arms with valve drive cams to a small value and facilitating replacement work of tappet-clearance adjusting shims.

In some embodiments, the valve drive system is characterized in that the rocker arm is slidable between a first position at which the pushing portion engages the shim and a second position at which the pushing portion is disengaged from the shim, and held in the first position through a spring.

Thus, the frictional resistance produced in the contact portions of rocker arms with cams on a camshaft can be reduced. Wear of cams can also be suppressed and the reduction in friction loss enables increased engine performance. In addition, adjustment of tappet clearance can be performed by selecting a shim of proper thickness and fitting the shim between the pushing portion of the rocker arm and the valve stem. Therefore, the rocker arm need not be provided with an additional adjusting screw and a lock nut, enabling size reduction and weight saving of the rocker arm.

In some embodiments, where the rocker arms can be dislocated to the sides of the valve stems, it is not necessary, at the time of replacement of shims, to remove the camshaft from the cylinder head, nor is it necessary to hold the valves are in the highest lift position with special tools. Thus, replacement work of shims can be performed easily, providing better working efficiency.

In accordance with one embodiment, a valve drive system for a four-stroke engine comprises a valve having a valve stem supported by a cylinder head, a camshaft having a cam configured to at least one of open and close the valve, and a rocker shaft disposed generally parallel to the camshaft The valve drive also includes a rocker arm having a roller in rolling contact with the cam and a pushing portion facing a top end of the valve stem, and supported on the rocker shaft for rocking movement; and a removable shim for adjusting tappet clearance disposed between the pushing portion of the rocker arm and the top end of the valve stem. The rocker arm is slidable between a first position in which the pushing portion is aligned with the shim and a second position laterally offset from the first position, and wherein the rocker arm is held in the first position through a spring.

In accordance with another embodiment, a valve drive system for a four-stroke engine comprises a cylinder head, at least one intake and at least one exhaust valve supported by the cylinder head disposed on sides of cylinder bore center line, and a camshaft disposed between a valve stem of the intake valve and a valve stem of the exhaust valve and having adjacent intake and exhaust cams. The valve drive also includes first and second rocker arms disposed parallel to each other and arranged along an axial direction of the camshaft, the first rocker arm being supported on a first rocker shaft for rocking movement and having at a first end a roller in rolling contact with the intake cam and at a second end a pushing portion facing a top end of a valve stem of the intake valve. The second rocker arm is supported on a second rocker shaft for rocking movement and having at one end a roller in rolling contact with the exhaust cam and at the other end a pushing portion facing the top end of the valve stem of the exhaust valve. Removable shims for adjusting tappet clearance are disposed between the pushing portion of the first rocker arm and the top end of the valve stem of the intake valve and between the pushing portion of the second rocker arm and the top end of the valve stem of the exhaust valve, respectively. The first and second rocker arms are slidable in the axial direction of the first and second rocker shafts between first positions at which the pushing portions engage the shims and second positions at which the pushing portions are disengaged from the shims, respectively, and held in the first positions through coil springs.

In accordance with yet another embodiment, a valve drive system for a four-stroke engine comprises a cylinder head having an external wall defining a valve drive chamber, and a support wall protruded from the bottom of the valve drive chamber and facing the external wall. An intake valve and an exhaust valve are supported by the cylinder head and disposed on different sides of a cylinder bore center line. A camshaft extends between the external wall and the support wall, located between a valve stem of the intake valve and a valve stem of the exhaust valve and having adjacent intake and exhaust cams. First and second rocker shafts extend between the external wall and the support wall and generally parallel to each other. A first rocker arm is supported on the first rocker shaft for rocking movement and includes a first end with a roller in rolling contact with the intake cam and a second end with a pushing portion facing a top end of the valve stem of the intake valve. A second rocker arm is supported on the second rocker shaft for rocking movement and includes a first end with a roller in rolling contact with the exhaust cam and s second end with a pushing portion facing a top end of the valve stem of the exhaust valve. Removable shims for adjusting tappet clearance are disposed between the pushing portion of the first rocker arm and the top end of the valve stem of the intake valve and between the pushing portion of the second rocker arm and the top end of the valve stem of the exhaust valve, respectively. Additionally, a reinforcement plate connects a protruded end of the support wall and the external wall for reinforcing the support wall. The first and second rocker arms are slidable in the axial direction of the first and second rocker shafts between first positions in which the pushing portions engage the shims and second positions in which the pushing portions are disengaged from the shims, respectively and wherein the reinforcement plate includes a first edge extending between the support wall and the external wall at a position corresponding to the first rocker shaft and a second edge extending between the support wall and the external wall at a position corresponding to the second rocker shaft, and formed, between the first and second edges of the reinforcement plate, with an opening for the first and second rocker arms to be exposed.

DETAILED DESCRIPTION OF THE PREFERRED EMBODIMENT

Figure 1:
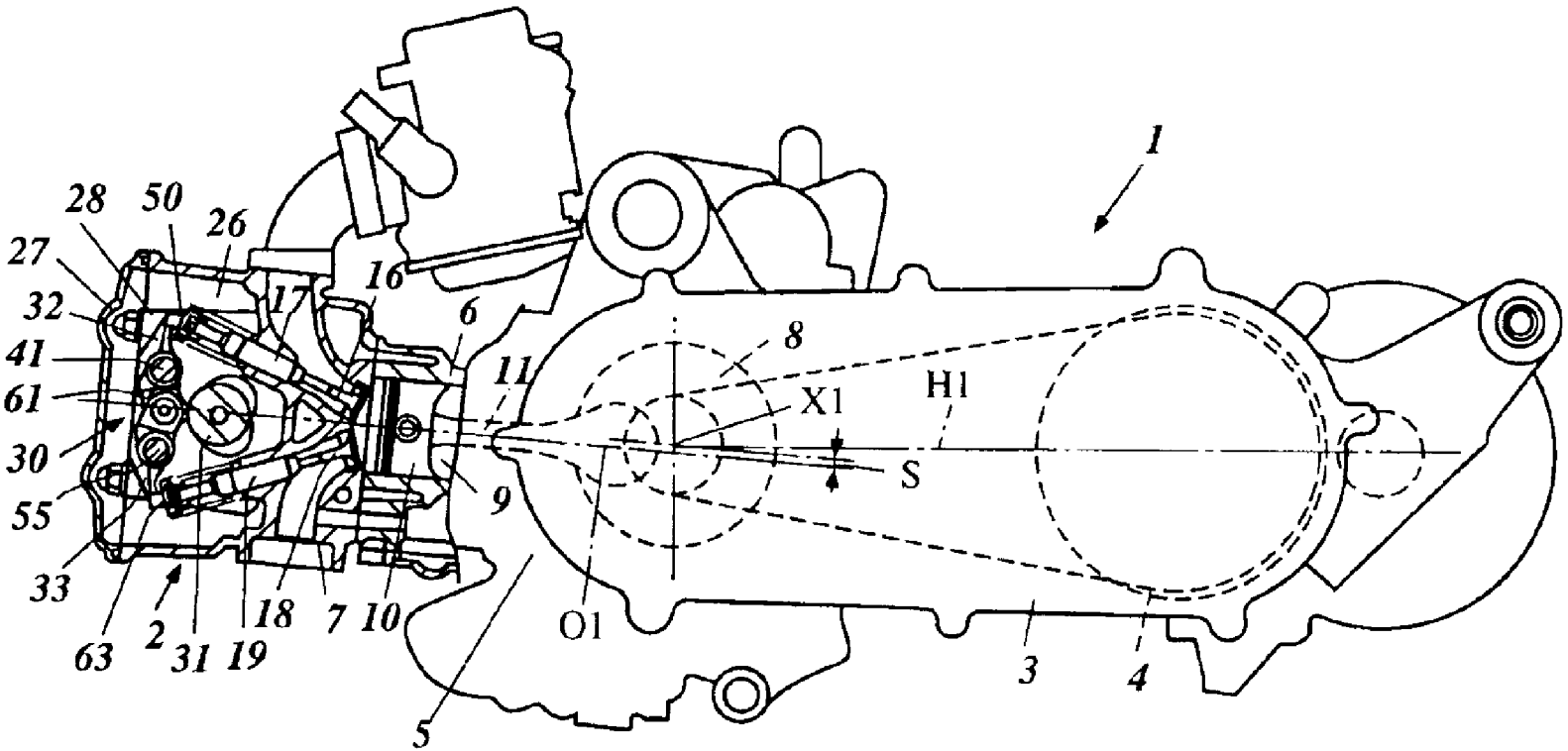
FIG. 1 is a side elevational and partial sectional view of an engine unit for a scooter-type motorcycle according to an embodiment.

With reference to the figures, preferred embodiments are described below in detail. FIG. 1 shows an example of an engine for a small of straddle-type vehicle with which embodiments of the present inventions can be used.

For example, the illustrated embodiment is a swing-type engine unit 1 for use, for example, but without limitation, with a scooter-type motorcycle. The engine unit 1 can include a water-cooled, four-stroke, single-cylinder engine 2, and a transmission case 3 acting also as a swing arm.

The transmission case 3 extends from the four-stroke engine 2 toward the drive wheel. For example, but without limitation, the transmission case 3 can extend toward the rear wheel (not shown) of a scooter-type motorcycle. The transmission case 3 can contain a V-belt type automatic transmission 4. A rear wheel (not shown) can be supported at the rear end of the transmission case 3, as noted above, and driven by the V-belt type automatic transmission 4.

The four-stroke engine 2 can include a crankcase 5 integrated with the transmission case 3, a cylinder block 6 and a cylinder head 7. The crankcase 5 can house a crankshaft 8. The crankshaft 8 can be disposed horizontally in the lateral direction of the body of an associated motorcycle and the left end of the crankshaft 8 can be connected to an input end of the V-belt type automatic transmission 4 through, for example, an automatic centrifugal clutch.

The cylinder block 6, in the illustrated embodiment, has one cylinder 9 and a piston 10 is housed in the cylinder 9. However, this is merely one type of engine that can be used with the present inventions. Other engine having other numbers of cylinders, in other cylinder arrangements (e.g., horiztonally opposed, V-type, W-type, etc) can also be sued.

In the illustrated embodiment, the piston 10 is connected to the crankshaft 8 through a connecting rod 11. The cylinder block 6 is protruded from the crankcase 5 approximately horizontally toward the front of the body of the motorcycle, and the bore center line O1 of the cylinder 9 is inclined a little upwardly toward the front to a horizontal line H1 passing through the center X1 of rotation of the crankshaft 8.

Further, the cylinder 9 can be offset such that its bore center line O1 is located below the center X1 of rotation of the crankshaft 8. The amount of offset S of the cylinder 9 is set to a value such that when the piston 10 is at the top dead center, the connecting rod 11 extends straight along the bore center line O1.

Since the cylinder 9 is offset as described above, when the piston 10 moves downwardly from the top dead center toward the bottom dead center, the inclination of the connecting rod 11 to the bore center line O1 can be suppressed. As a result, side pressure which has a tendency of pressing the piston 10 against the inner surface of the cylinder 9 is reduced, allowing reduction in the friction loss of the piston 10.

Figure 2:
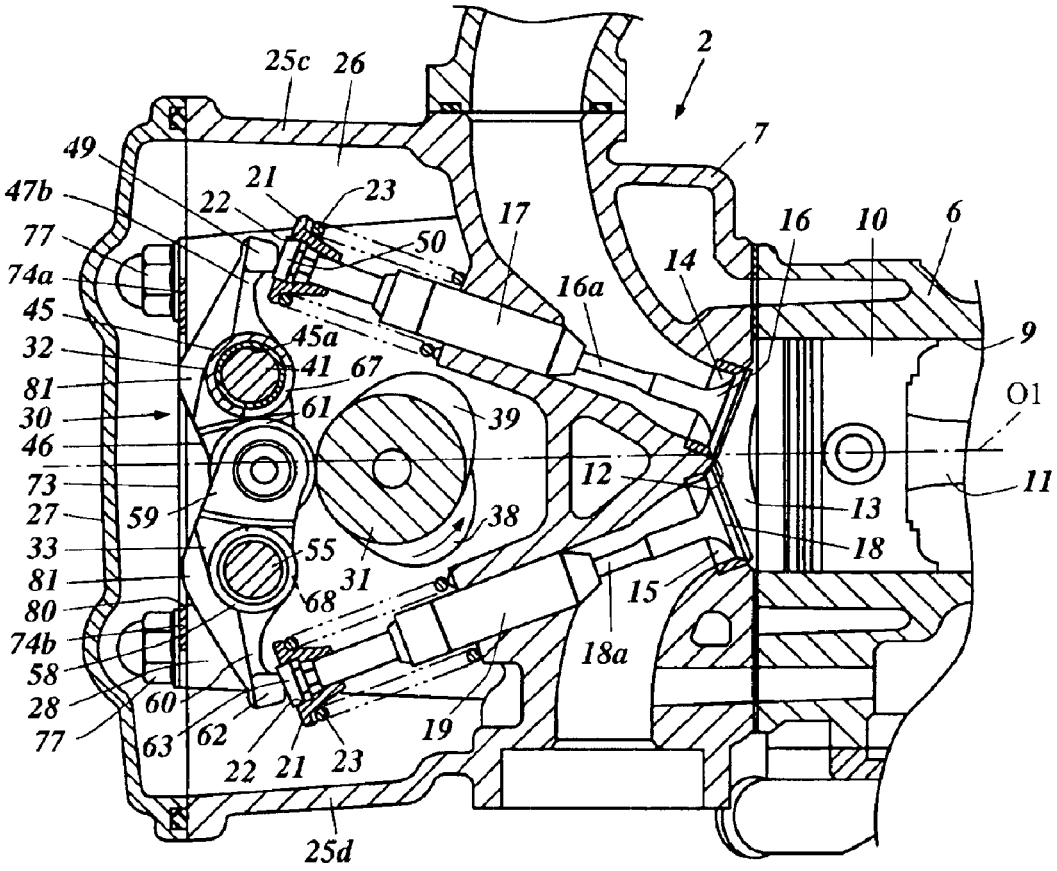
FIG. 2 is an enlarged sectional view of a cylinder head, valve train and partial view of a cylinder of the four-stroke engine showing the positional relation between a camshaft, a first rocker arm for opening/closing intake valves and a second rocker arm for opening/closing an exhaust valve.

As shown in FIG. 2, the cylinder head 7 can include a recess 12 in its surface facing the cylinder 9. The recess 12 can define a combustion chamber 13, together with the piston 10.

The cylinder head 7 is provided with a pair of intake ports 14 (only one port is shown) open to the combustion chamber 13 and a single exhaust port 15 open to the combustion chamber 13. The intake ports 14 are located above the bore center line O1 and the exhaust port 15 is located below the bore center line O1. However, other arrangements of the intake and exhaust ports can also be used.

The intake ports 14 are opened and closed by two intake valves 16 (only one valve is shown), however, other numbers of intake valve can also be used. Valve stems 16*a* of the intake valves 16 are supported by the cylinder head 7 through valve guides 17, respectively. The valve stems 16*a* are disposed parallel to each other and each inclined upwardly away from the bore center line O1 toward the end of the stem distant from the combustion chamber 13.

The exhaust port 15 is opened and closed by one exhaust valve 18, however, other numbers of exhaust valves can also be used. A valve stem 18*a* of the exhaust valve 18 is supported by the cylinder head 7 through a valve guide 19. The valve stem 18*a* is inclined downwardly away from the bore center line O1 toward the end of the stem distant from the combustion chamber 13.

Spring retainers 21 are attached to the top ends of the valve stems 16*a*, 18*a*, respectively. The spring retainer 21 has a fitting hole 22 at the center and the top end of each of the valve stems 16*a*, 18*a* is fitted in the fitting hole 22. A valve spring 23 is placed between the spring retainer 21 at the outside circumferential portion and the cylinder head 7. The intake valves 16 and the exhaust valve 18 are biased by the valve springs 23 toward closing of the intake ports 14 and exhaust port 15.

Figure 3:
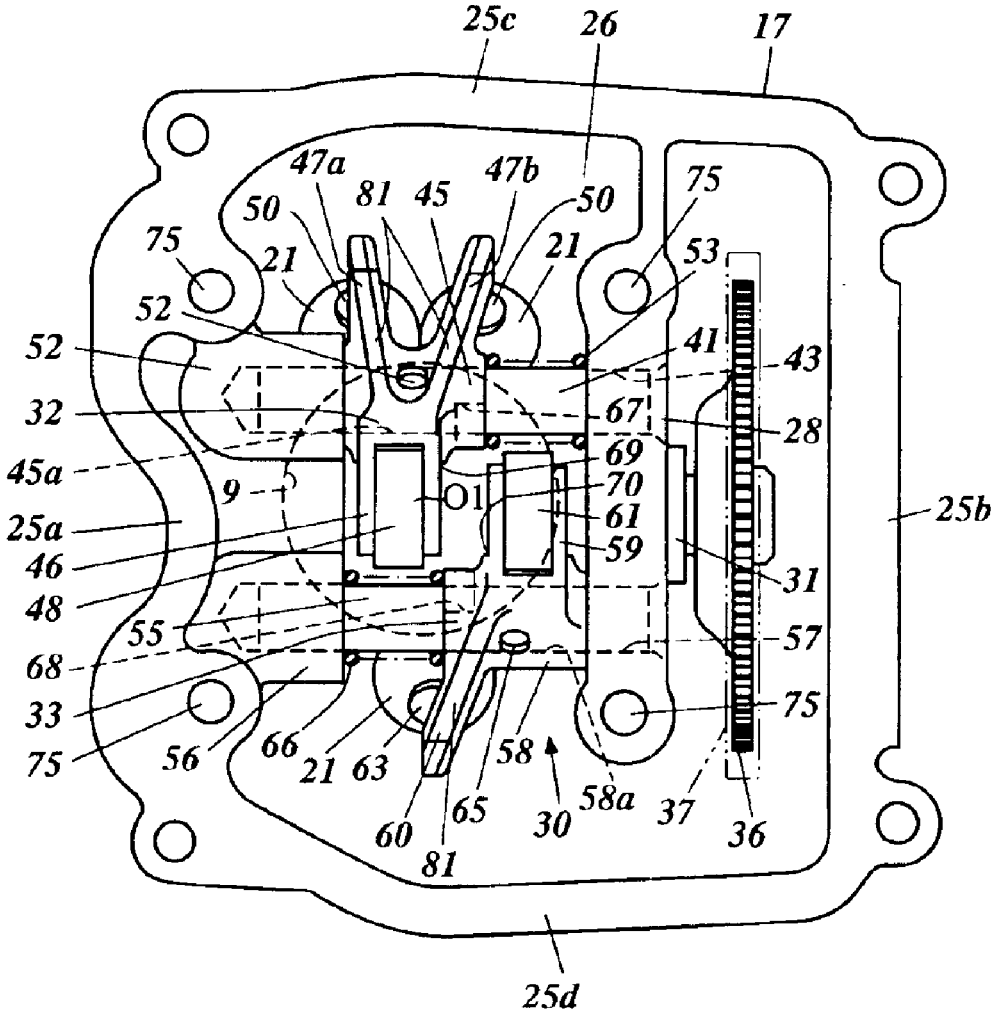
FIG. 3 is a front elevational view of a cylinder head with a cylinder head cover removed in which the first and second rocker arms are held in their respective first positions.
Figure 4:
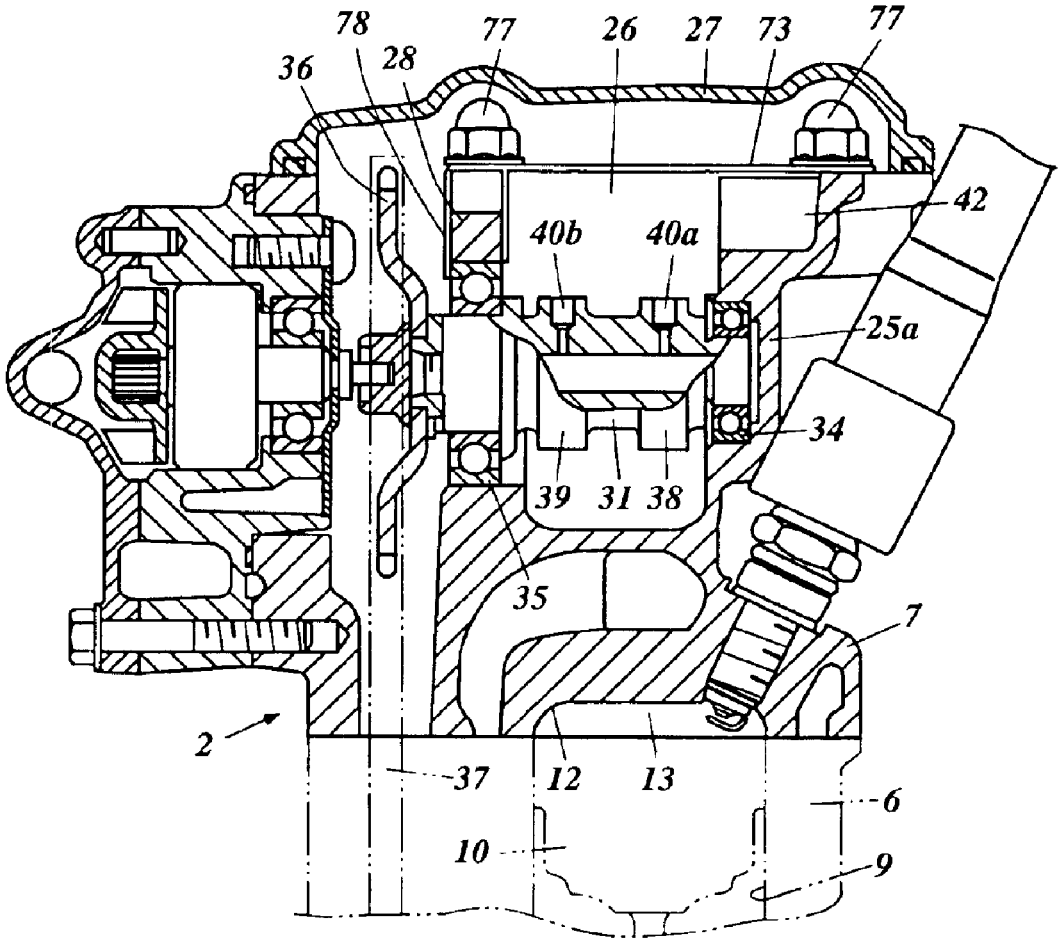
FIG. 4 is a top plan and sectional view of the cylinder head having a camshaft.

As shown in FIG. 2 through FIG. 4, the cylinder head 7 has first through fourth external walls 25*a*, 25*b*, 25*c*, 25*d* extending on the opposite side from the cylinder block 6. The first external wall 25*a* and the second external wall 25*b* face each other laterally on both sides of the bore center line O1. The third external wall 25*c* and the fourth external wall 25*d* are adjacent to the first and second external walls 25*a*, 25*c*, respectively, and face each other vertically on both sides of the bore center line O1.

The first through fourth external walls 25*a*–25*d* constitute a valve drive chamber 26 in cooperation with each other. The valve drive chamber 26 opens toward the front of the four-stroke engine 2. The valve stems 16*a* of the intake valves 16 and the valve stem 18*a* of the exhaust valve 18 are protruded into the valve drive chamber 26. The opening end of the valve drive chamber 26 is covered by a removable head cover 27.

The cylinder head 7 has a support wall 28 protruded from the bottom of the valve drive chamber 26. The support wall 28 is disposed between the first external wall 25*a* and second external wall 25*b*, one side of which is connected to the external wall 25*c*. The valve stems 16*a* of the intake valves 16 and the valve stem 18*a* of the exhaust valve 18 protruded into the valve drive chamber 26 are located between the first external wall 25*a* and support wall 28.

The valve drive chamber 26 houses a valve drive system 30 for driving the intake valves 16 and exhaust valve 18 for opening and closing the valves 16, 18. The valve drive system 30 includes a camshaft 31, an intake first rocker arm 32 and an exhaust second rocker arm 33.

As shown in FIG. 4, the camshaft 31 can be supported at one end by the first external wall 25*a* with a bearing 34 and at the other end by the support wall 28 with a bearing 35. The camshaft 31 is disposed generally perpendicular to the bore center line O1 and generally horizontally in the lateral direction of the body.

A cam sprocket 36 can be fixed to the other end of the camshaft 31, however, other drive mechanisms can also be used. A cam chain 37 is meshed with the cam sprocket 36 and camshaft 31. This allows the camshaft 31 to normally rotate counterclockwise (rotational direction of the rear wheel when the motorcycle advances) as shown in FIG. 2 by the arrow on the camshaft.

The camshaft 31 is provided with an intake cam 38 and an exhaust cam 39. The intake cam 38 and the exhaust cam 39 are disposed side by side in the axial direction of the camshaft 31. In addition, the camshaft 31 can include first and second oil-jetting holes 40*a*, 40*b* as shown in FIG. 4.

The first oil-jetting hole 40*a* opens at the outside circumferential surface of the base circle of the intake cam 38 and the second oil-jetting hole 40*b* opens at the outside circumferential surface of the base circle of the exhaust cam 39. The first and second oil-jetting holes 40*a*, 40*b* serve as means for supplying lubricating oil to portions of the valve drive system 30, through which pressurized lubricating oil is jetted out from these oil-jetting holes 40*a*, 40*b* into the valve drive chamber 26. However, other means for lubricating can also be used.

As shown in FIG. 2 and FIG. 3, the intake first rocker arm 32 is supported by the cylinder head 7 through a first rocker shaft 41. The first rocker shaft 41 is disposed generally parallel to the axis of the camshaft 31 and at a position offset upwardly of the camshaft 31. The first rocker shaft 41 extends between the first external wall 25*a* and support wall 28. In the illustrated embodiment, one end of the first rocker shaft 41 is fitted in a bearing portion 42 protruded from the first external wall 25*a* into the valve drive chamber 26 and the other end of the first rocker shaft 41 is fitted in a bearing hole 43 penetrating the support wall 28.

With continued reference to FIGS. 2 and 3, the first rocker arm 32 includes a cylindrical boss 45, a roller support portion 46 and a pair of arm portions 47*a*, 47*b*. The boss 45 has a bearing hole 45*a* in the axial direction, and the first rocker shaft 41 passes through the bearing hole 45*a* for axial and circumferential sliding movement.

The roller support portion 46 is formed in the shape of a fork, however, other shapes can also be used. The roller support portion 46 protrudes generally downwardly from the outside circumferential surface of the boss 45 and supports a roller 48 for rotation. The roller 48 is located at one end of the first rocker arm 32 and in rolling contact with the outside circumferential surface of the intake cam 38 on the camshaft 31.

The arm portions 47*a*, 47*b* extend generally upwardly from the outer circumferential surface of the boss 45. These arm portions 47*a*, 47*b* are inclined, generally in the shape of a letter V in directions of separation from each other toward the upper ends when the first rocker arm 32 as viewed from the direction of the head cover 27, although other shapes can also be used. The protruded ends of the arm portions 47*a*, 47*b* extend towards the top ends of the valve stems 16*a* of the intake valves 16. Pushing portions 49 are disposed at the protruded ends and extend toward the top ends of the valve stems 16*a*, respectively. The pushing portions 49 are located opposite the roller support portion 46 with the boss 45 therebetween.

A disk-like shim 50 is placed between the pushing portion 49 of the first rocker arm 32 and the top end of the valve stem 16*a*. The shim 50 serves as means for adjusting tappet clearance. The shim 50 is removably fitted in the fitting hole 22 of the spring retainer 21 and in direct contact with the pushing portion 49 of the first rocker arm 32.

Measurement of the tappet clearance is performed by inserting a thickness gauge, also known as a "feeler gauge", between the pushing portion 49 of the first rocker arm 32 and the shim 50. The tappet clearance of the intake valve can be adjusted to a specified value by replacing the shim 50 with a new one with different thickness based on the measurement result.

Figure 7:
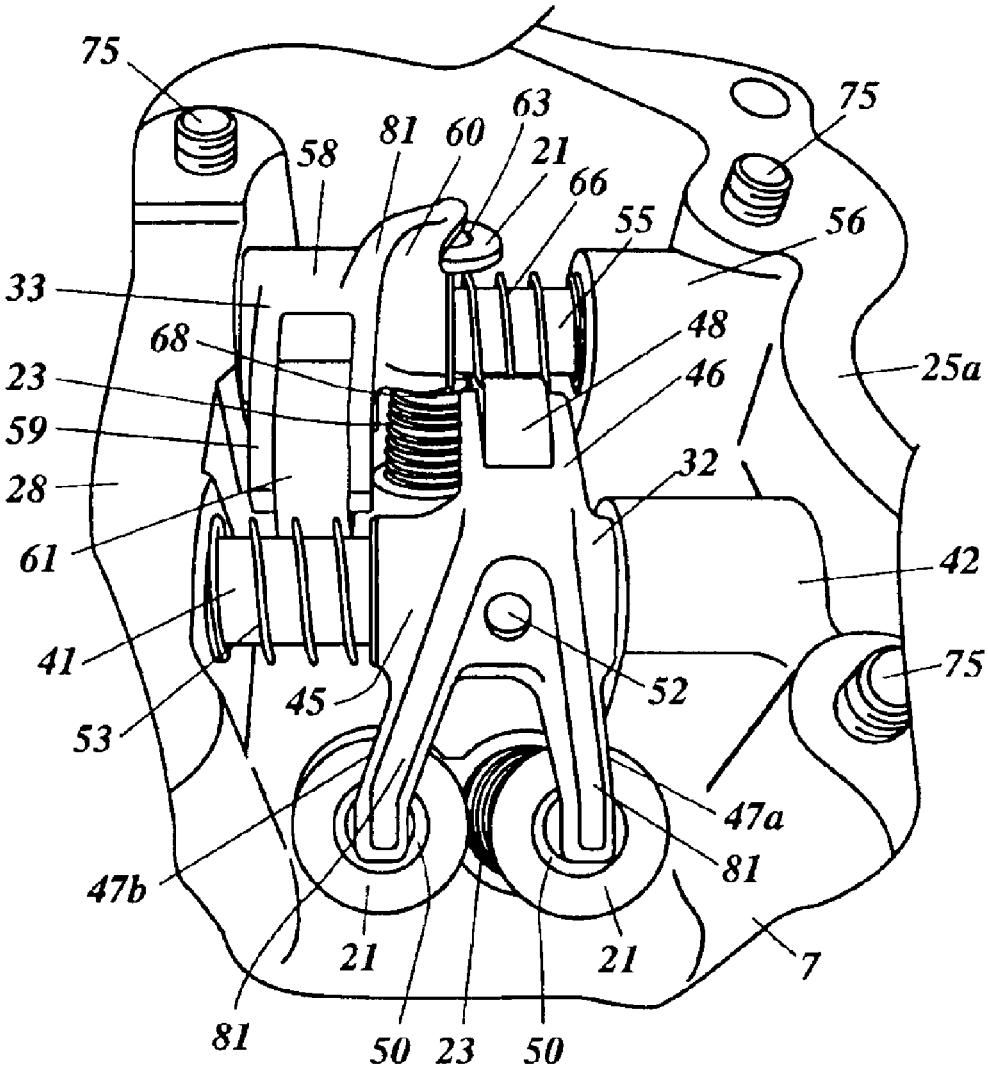
FIG. 7 is a perspective view of the cylinder head, with a cylinder head cover removed, in which the first and second rocker arms are held in their respective first positions.

As shown in FIG. 3 and FIG. 7, the boss 45 of the first rocker arm 32 is formed with an oil supply hole 52. The oil supply hole 52 communicates with the bearing hole 45*a* of the boss 45. As such, the oil supply hole 52 serves as means for introducing lubricating oil jetted out from the oil-jetting holes 40*a*, 40*b* of the camshaft 31 into the space between the boss 45 and the rocker shaft 41. Other oil supply hole arrangements can also be used.

In the illustrated embodiment, the oil supply hole 52 is located between the bases of the arm portions 47*a*, 47*b*. Therefore, lubricating oil jetted out from the oil-jetting holes 40*a*, 40*b* into the valve drive chamber 26, runs down the arm portions 47*a*, 47*b* and can flow into the oil supply hole 52. In other words, lubricating oil is collected in the region around the bases of the V-shaped arm portions 47*a*, 47*b* and stored there. As a result, sufficient amounts of lubricating oil can be introduced between the boss 45 and the first rocker shaft 41, even at the time of engine start, or during idling when the amount of jetted lubricating oil discharged from the holes 40*a*, 40*b* is smaller, thus improving reliability of the lubrication.

A further advantage is provided where the boss 45 of the first rocker arm 32 is supported on the first rocker shaft 41 for axial sliding movement. For example, with the engine 1 assembled for operation, the first rocker arm 32 can be slidable in the axial direction of the first rocker shaft 41 between a first position (shown in FIG. 3) in which the pushing portions 49 of the arm portions 47*a*, 47*b* face the top ends of the valve stems 16*a* and a second position (shown in FIG. 8) in which the pushing portions 49 of the arm portions 47*a*, 47*b* are offset laterally from the top ends of the valve stems 16*a*.

The first rocker arm 32 is biased by a coil spring 53 toward the first position. The coil spring 53 is mounted on the first rocker shaft 41 and compressed between the support wall 28 and boss 45. Therefore, the boss 45 of the first rocker arm 32 is pressed against the end face of the bearing portion 42 of the first external wall 25*a*, and the first rocker arm 32 is held in the first position. During operation of the engine 1, the coils spring 53 provides a sufficient biasing force to retain the rocker arm 32 against the end face of the bearing portion 42.

Similarly, the exhaust second rocker arm 33 is supported by the cylinder head 7 through a second rocker shaft 55. The second rocker shaft 55 is disposed along the axis of the camshaft 31 at a position offset downwardly of the camshaft 31. Thus, the first and second rocker shafts 41, 55 are disposed parallel to each other on both sides of the camshaft 31 when the cylinder head 7 is viewed from the direction of the opening end of the valve drive chamber 26.

The second rocker shaft 55 extends between the first external wall 25*a* and support wall 28. More specifically, one end of the second rocker shaft 55 is fitted in a bearing portion 56 protruded from the first external wall 25*a* into the valve drive chamber 26 and the other end of the second rocker shaft 55 is fitted in a bearing hole 57 penetrating the support wall 28.

The second rocker arm 33 includes a cylindrical boss 58, a roller support portion 59 and a single arm portion 60. The boss 58 has a bearing hole 58*a* in the axial direction, and the second rocker shaft 55 passes through the bearing hole 58*a* for axial and circumferential sliding movement.

The roller support portion 59 is formed in the shape of a fork and protruded upwardly from the outside circumferential surface of the boss 58, however, other shapes can also be used. The roller support portion 59 supports a roller 61 for rotation. The roller 61 is located at one end of the second rocker arm 33 and in rolling contact with the outside circumferential surface of the exhaust cam 39 on the camshaft 31.

The arm portion 60 is protruded downwardly from the outside circumferential surface of the boss 58. The protruded end of the arm portion 60 faces the top end of the rocker stem 18*a* of the exhaust valve 18. A pushing portion 62 is disposed at the protruded end and extends out toward the top end of the valve stem 18*a*. The pushing portion 62 is located opposite to the roller support portion 59 with the boss 58 therebetween.

A disk-like shim 63 is placed between the pushing portion 62 of the second rocker arm 33 and the top end of the valve stem 18*a*. The shim 63 serves as means for adjusting tappet clearance. The shim 63 is fitted removably in the fitting hole 22 of the spring retainer 21 and in direct contact with the pushing portion 62 of the second rocker arm 33.

Measurement of the tappet clearance, like that of the intake valve, is performed by inserting a thickness gauge between the pushing portion 62 of the second rocker arm 33 and the shim 63. The tappet clearance of the exhaust valve can be adjusted to a specified value when the shim 63 is replaced with a new one with different thickness based on the measurement result.

The boss 58 of the second rocker arm 33 is formed with an oil supply hole 65. The oil supply hole 65 serves as a means of introducing lubricating oil jetted out from the oil-jetting holes 40*a*, 40*b* of the camshaft 31 into a space between the boss 58 and the second rocker shaft 55, and opens to the bearing hole 58*a* of the boss 58.

The boss 58 of the second rocker arm 33 is supported on the second rocker shaft 55 for axial sliding movement. More specifically, the second rocker arm 33 is slidable in the axial direction of the second rocker shaft 55 between a first position (shown in FIG. 3) in which the pushing portion 62 of the arm portion 60 faces the top end of the valve stem 18*a* and a second position (shown in FIG. 9) in which the pushing portion 62 of the arm portion 60 is offset laterally from the top end of the valve stem 18*a*.

The second rocker arm 33 is biased by a coil spring 66 toward the first position, however, other types of springs or biasing means can also be used. The coil spring 66 is mounted on the second rocker shaft 55 and compressed between the bearing portion 56 of the first external wall 25*a* and boss 58. Therefore, the boss 58 of the second rocker arm 33 is pressed against the support wall 28, and the second rocker arm 33 is held in the first position. During operation, the coil spring 66 provides a sufficient biasing force to retain the rocker arm 33 against the support wall 28.

The first rocker arm 32 and the second rocker arm 33 are biased in opposite directions to each other along the axes of the first and second rocker shafts 41, 55. As a result, as shown in FIG. 3, when the first and second rocker arms 32, 33 are held in their respective first positions, the roller 48 of the first rocker arm 32 faces the coil spring 66 on the second rocker shaft 55 and the roller 61 of the second rocker arm 33 faces the coil spring 53 on the first rocker shaft 41.

Therefore, as long as the first and second rocker arms 32, 33 are held in their first positions, the rollers 48, 61 are apart from each other in the axial direction of the first and second rocker shafts 41, 55. In the illustrated embodiment, the two rollers 48, 61 are in line coaxially, although other arrangements can also be used.

As shown in FIG. 3, one end of the boss 45 of the first rocker arm 32 is adjacent to the roller 61 of the second rocker arm 33 when the first and second rocker arms 32, 33 are held in their respective first positions. A further advantage is provide where a cutout 67 is formed at one end of the boss 45. The cutout 67 can serve as a means of avoiding interference of the roller 61 of the second rocker arm 33 with the boss 45 when the first rocker arm 32 or the second rocker arm 33 is slid from the first position to the second position, and opens at the outside circumferential surface of the boss 45.

Similarly, one end of the boss 58 of the second rocker arm 33 is adjacent to the roller 48 of the first rocker arm 32 when the first and second rocker arms 32, 33 are held in the respective first positions. A cutout 68 can be formed at one end of the boss 58. The cutout 68 serves as means for avoiding interference with the roller 48 of the first rocker arm 32 when the first rocker arm 32 or the second rocker arm 33 is slid from the first position to the second position, and opens at the outside circumferential surface of the boss 58.

Further, the roller support portion 46 of the first rocker arm 32 and the roller support portion 59 of the second rocker arm 33 have side faces facing each other. In the side faces of the roller support portions 46, 59 are formed relief portions 69, 70 cut off to reduce their thickness, respectively. The relief portions 69, 70 serve as means for avoiding interference between the roller support portions 46, 59, when the first rocker arm 32 or the second rocker arm 33 is slid from the first position to the second position and face each other.

Figure 5:
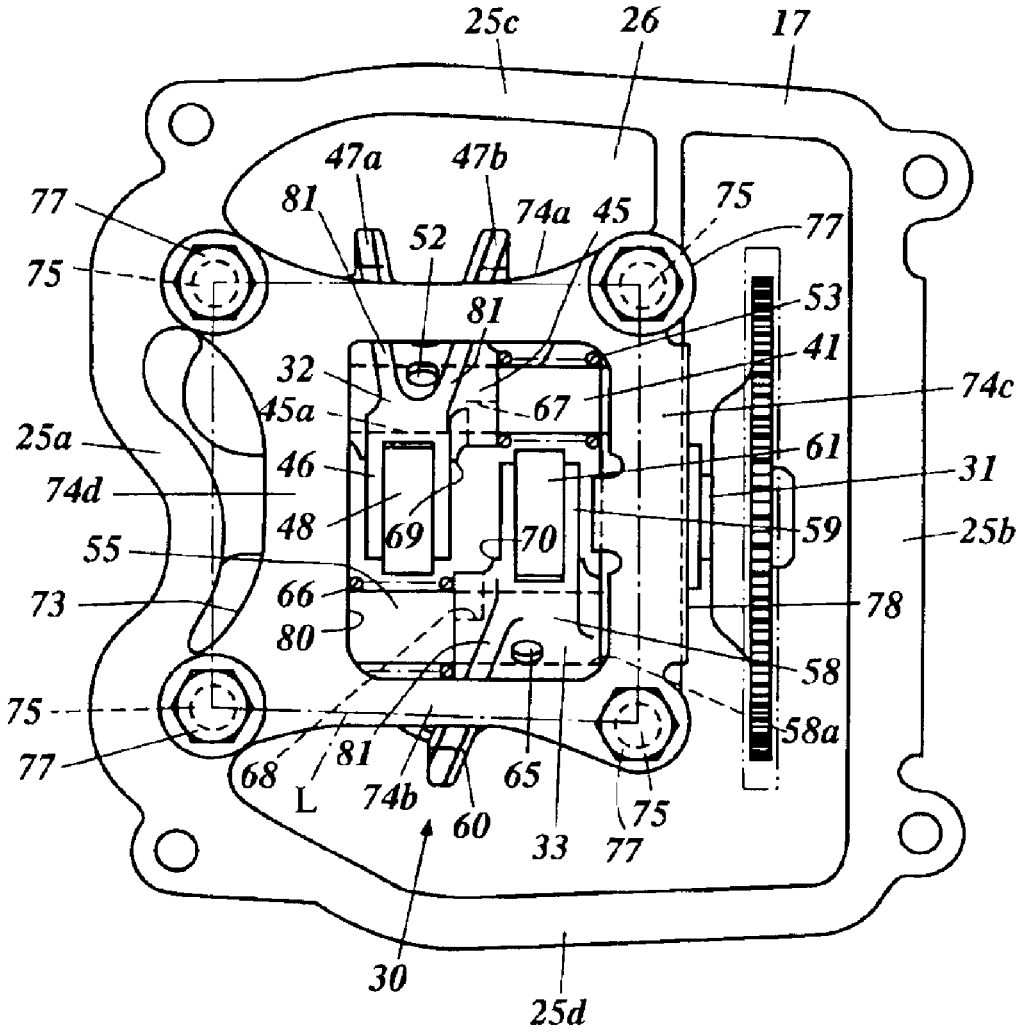
FIG. 5 is a front elevational view of the cylinder head, with a cylinder head cover removed, showing the positional relation between an opening of a reinforcement plate and the first and second rocker arms.

As shown in FIG. 2 and FIG. 5, a reinforcement plate 73 for reinforcing the support wall 28 is fixed to the cylinder head 7. The reinforcement plate 73 extends between the end face of the first external wall 25*a* and the protruded end face of the support wall 28 and is placed between the first and second rocker arms 32, 33 and the head cover 27.

Figure 6:
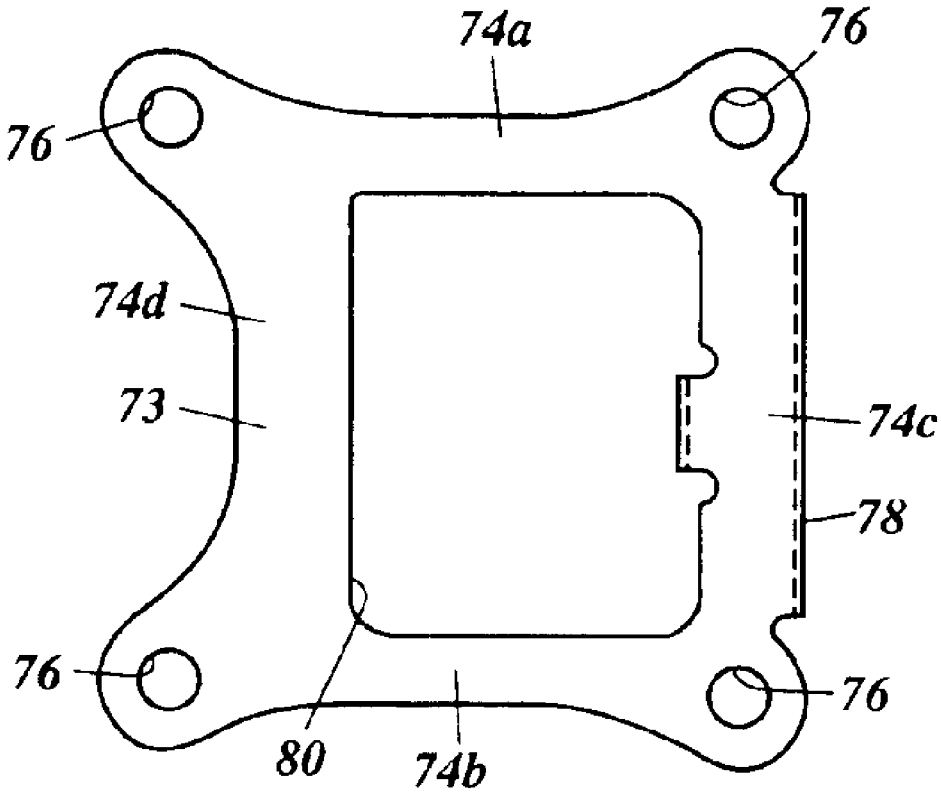
FIG. 6 is a front elevational view of the reinforcement plate removed from the engine.

As shown in FIG. 6, the reinforcement plate 73 is made of an approximately square metal plate having first-fourth edges 74*a*, 74*b*, 74*c*, 74*d*. The first edge 74*a* of the reinforcement plate 73 extends between the first external wall 25*a* and support wall 28 at a position corresponding to the first rocker shaft 41. The second edge 74*b* extends between the first external wall 25*a* and support wall 28 at a position corresponding to the second rocker shaft 55. The third edge 74*c* connects one end of the first edge 74*a* and that of the second edge 74*b* and overlaps the protruded end face of the support wall 28. The fourth edge 74*d* connects the other end of the first edge 74*a* and that of the second edge 74*b*.

As shown in FIG. 2 and FIG. 5, the first edge 74*a* of the reinforcement plate 73 crosses the arm portions 47*a*, 47*b* of the first rocker arm 32. The protruded ends of the arm portions 47*a*, 47*b* extend upwardly of the reinforcement plate 73, and the contact portions of the pushing portions 49 of the arm portions 47*a*, 47*b* with the shims 50 are exposed to the front of the valve drive chamber 26 without being covered by the reinforcement plate 73.

Likewise, the second edge 74*b* of the reinforcement plate 73 crosses the arm portion 60 of the second rocker arm 33. The protruded end of the arm portion 60 extends downwardly of the reinforcement plate 73, and the contact portion of the pushing portion 62 of the arm portion 60 with the shim 63 is exposed to the front of the valve drive chamber 26 without being covered by the reinforcement plate 73.

As shown in FIG. 3 and FIG. 7, a pair of stud bolts 75 extend from the protruded end face of the support wall 28 and the top end face of the first external wall 25*a*, respectively. The stud bolts 75 pass through passing holes 76 formed in the four corners of the reinforcement plate 73, and nuts 77 are screwed on the stud bolts 75 at the top ends. Therefore, the reinforcement plate 73 is fixed, at the four corners, to the cylinder head 7 and connects the protruded end of the support wall 28 to the first external wall 25*a*.

As shown in FIG. 5 and FIG. 6, the third edge 74*c* of the reinforcement plate 73 is formed with a lip 78 extending along the support wall 28. The lip piece 78 can be formed by bending the plate 73, attaching a separate member, or any other method. The lip piece 78 serves as a means of preventing the first and second rocker shafts 41, 55 from slipping off, by closing the bearing holes 43, 57 of the support wall 28. In addition, the lip piece 78 serves as a means of preventing the bearing 34 from slipping off, by engaging the end face of the bearing 34 supporting the camshaft 31 on the support wall 28.

The reinforcement plate 73 can have a square opening 80, however, other shapes can also be used. The opening 80 serves as a means of exposing the first and second rocker arms 32, 33 to the front of the valve drive chamber 26. In the illustrated embodiment, the opening 80 is located in a region surrounded by a straight line L connecting the four through holes 76, however, other arrangements can also be used. The opening 80 of the reinforcement plate 73 has a size sufficient to expose the bosses 45, 58 and roller support portions 46, 59 of the rocker arms 32, 33 when the first and second rocker arms 32, 33 are held in their first positions.

A further advantage is provided where first and second rocker arms 32, 33 are provided with rib-like projections 81 protruded toward the opening 80 of the reinforcement plate 73, respectively. The projections 81 are formed in regions ranging from the outside circumferential surfaces of the bosses 45, 58 to the roller support portions 46, 59 and extend in the direction crossing the sliding direction of the first and second rocker arms 32, 33. As such, the projections 81 can make it easier for a mechanic or user to slide the rocker arms 32, 33 during a tappet clearance adjustment procedure.

In a procedure for adjusting the tappet clearance, the head cover 27 is typically is removed from the cylinder head 7 so as to open the valve drive chamber 26 of the cylinder head 7. Next, a user or mechanic can insert a finger tip into the opening 80 of the reinforcement plate 73 and slide either the rocker arm 32 or 33 from the first position to the second position against the biasing force of the coil spring 53 or 66. For example, the projection 81 of the first rocker arm 32 or that of the second rocker arm 33 can provide a ledge for the fingertip of the user or mechanic to grip the rocker 32, 33.

Figure 8:
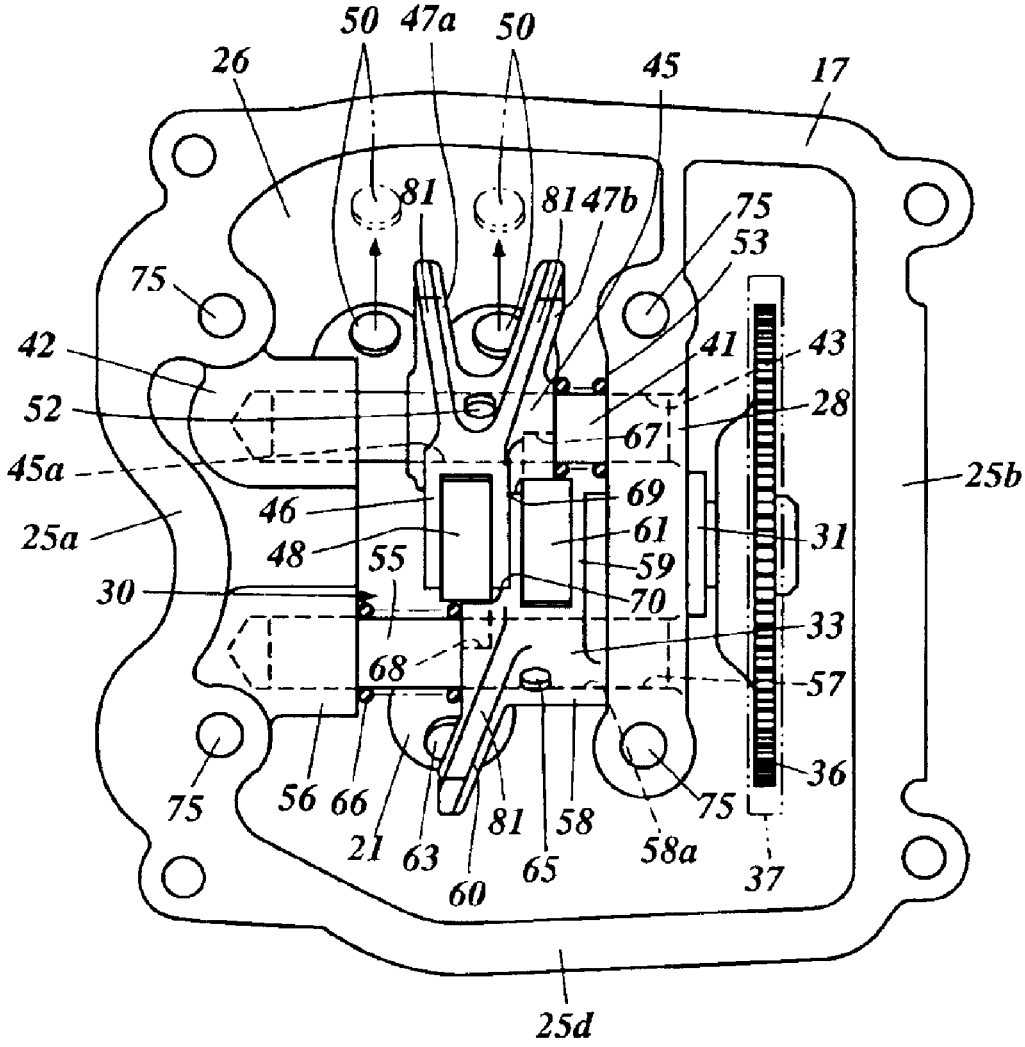
FIG. 8 is a front elevational view of the cylinder head, with a cylinder head cover removed, in which the first rocker arm is slid to its second position.

FIG. 8 shows the first rocker arm 32 on the intake side moved to the second position. At the second position, the pushing portions 49 at the protruded ends of the arm portions 47*a*, 47*b* are offset laterally from the shims 50. In this condition, a mechanic can manipulate, for example, a magnet driver from above the first edge 74*a* of the reinforcement plate 73 toward the spring retainers 21 and remove the shims 50 from the fitting holes 22 of the spring retainers 21 with the magnet driver.

New shims 50 with different thickness can then be fit into the fitting holes 22. The first rocker arm 32 can then be released, allowing it to slide from the second position back to the first position. As a result, the pushing portions 49 of the first rocker arm 32 come in contact with the new shims and adjustment of the tappet clearance on the intake side is completed.

Figure 9:
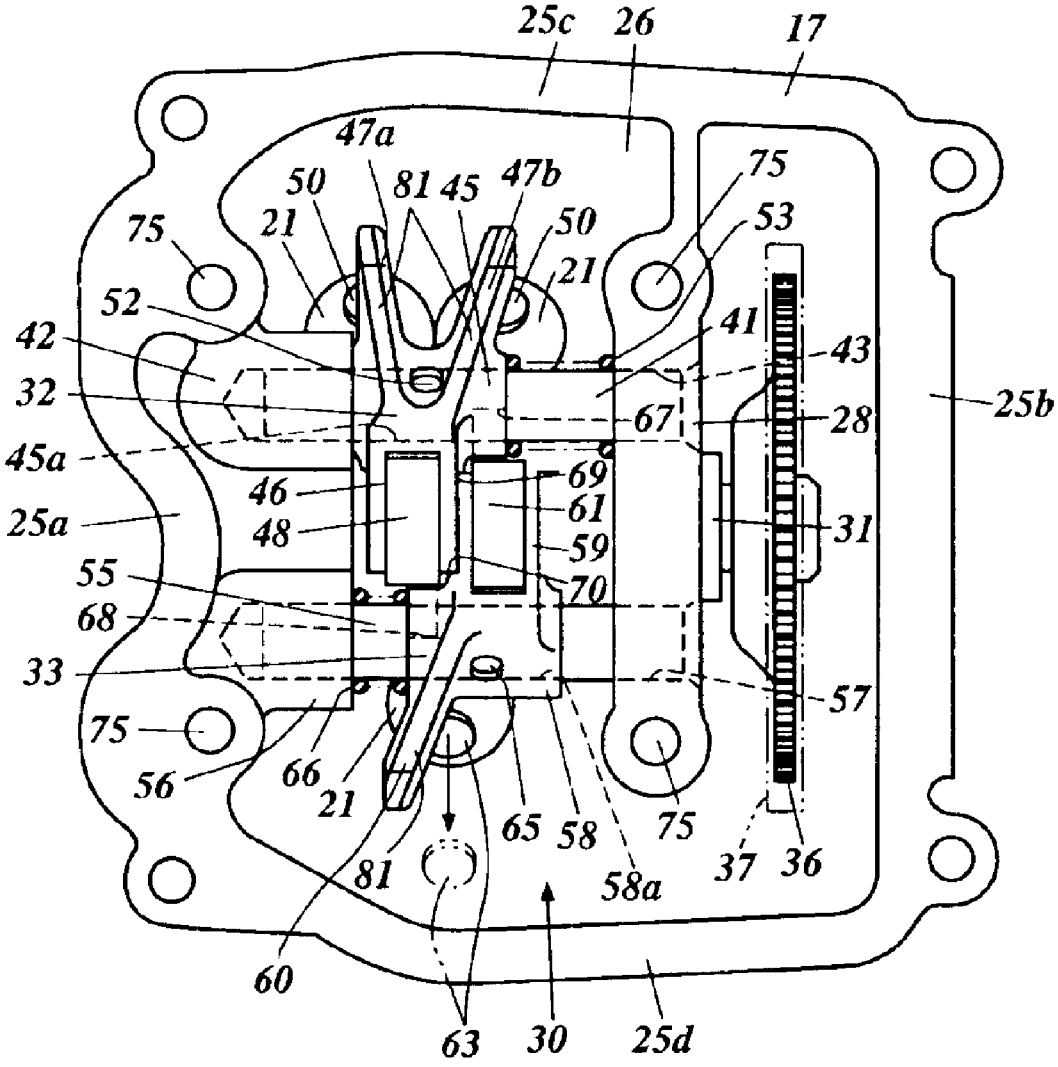
FIG. 9 is a front elevational view of the cylinder head, with a cylinder head cover removed, in which the second rocker arm is slid to its second position.

FIG. 9 shows the second rocker arm 33 on the exhaust side disposed in the second position. At the second position, the pushing portion 62 at the protruded end of the arm portion 60 is offset laterally from the shim 63. In this condition, as in the intake side rocker arm, a magnet driver can be manipulated from below the second edge 74*b* of the reinforcement plate 73 toward the spring retainer 21 and the shim 63 can be removed from the fitting hole 22 of the spring retainers 21 with the magnet driver.

A new shim 63 with a different thickness can then be fitted into the fitting hole 22 and the second rocker arm 33 can be released allowing it to slide from the second position to the first position. As a result, the pushing portion 63 of the second rocker arm 33 come in contact with the new shim 63 and adjustment of the tappet clearance on the exhaust side is completed.

In the four-stroke engine 2 as described above, the first rocker arm 32 on the intake side has a roller 48 in rolling contact with the intake cam 38 and the second rocker arm 33 on the exhaust side has a roller 61 in rolling contact with the exhaust cam 39. Therefore, the friction resistance produced in the contact portions of the intake and exhaust cams 38, 39 with the first and second rocker arms 32, 33 is mitigated, suppressing the wear of the intake and exhaust cams 38, 39. In addition, the friction loss of the first and second rocker arms 32, 33 decreases, thereby enhancing engine performance.

Adjustment of the tappet clearance is performed by selecting shims 50, 63 with appropriate thickness and fitting them between the pushing portions 49, 62 of the first and second rocker arms 32, 33 and the valve stems 16*a*, 18*a*. Therefore, the first and second rocker arms 32, 33 need not be provided with additional adjusting screws and lock nuts, enabling size reduction and weight saving of these rocker arms 32, 33.

In addition, the replacement of the shims 50, 63 is performed by sliding the first and second rocker arms 32, 33 from their first positions to their second positions. Therefore, it is not necessary that the camshaft 31 be removed from the cylinder head 7 each time the shims 50, 63 are replaced, nor is it necessary to hold the intake and exhaust valves 16, 18 in the highest lift state using special tools. This enables a simplified procedure for replacing the shims 50, 63, providing a better working efficiency.

Further, since the reinforcement plate 73 for reinforcing the support wall 28 is formed with an opening 80 large enough to expose the bosses 45, 58 and roller support portions 46, 55 of the first and second rocker arms 32, 33, the first and second rocker arms 32, 33 can be slid more easily. For example, a finger tip inserted through the opening 80 can be sufficient to slide the first and second rocker arms 32, 33.

For example, as noted above, the first and second rocker arms 32, 33 can be formed with projections 81 protruded toward the opening 80. These projections 81 extend in a direction transverse to the sliding direction of the first and second rocker arms 32, 33. Thus, the first and second rocker arms 32, 33 can be gripped reliably by a finger tip inserted in the opening 80, facilitating sliding operation of these rocker arms 32, 33.

Furthermore, in this arrangement, the bosses 45, 58 of the first and second rocker arms 32, 33 are formed with cutouts 67, 68 for avoiding interference with the rollers 48, 61 of the opposed first and second rocker arms 32, 33, respectively. Likewise, the roller support portions 46, 59 of the first and second rocker arms 32, 33 are formed with relief portions 69, 70 cut off to avoid interference with the opposed roller support portions 46, 59.

Therefore, although a construction is adopted in which the first and second rocker arms 32, 33 are slidable, both of these rocker arms can be disposed close to each other in the axial direction of the camshaft 31 and the distance between the first and second rocker shafts 41, 55 can be decreased.

As a result, the valve drive system 30 can be arranged compact, enabling size reduction of the cylinder head 7.

Although in the first embodiment, the intake and exhaust valves are opened and closed by one camshaft, this invention is not limited to that. For example, an intake camshaft and an exhaust camshaft may be disposed in a cylinder head and intake valves and an exhaust valve may be opened/closed separately by these two camshafts.

Further, the numbers of the intake and exhaust valves are not limited to those in the foregoing embodiment, but they may be two and two, respectively, or one intake valve and one exhaust valve may be used.

Although the present inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some aspects of some of the present inventions herein disclosed should not be limited by the particular disclosed embodiments described above, but should be determined only by a fair reading of the claims that follow.

What is claimed is:

1. A valve drive system for a four-stroke engine, comprising:

a valve having a valve stem supported by a cylinder head;

a camshaft having a cam configured to at least one of open and close the valve;

a rocker shaft disposed generally parallel to the camshaft;

a rocker arm having a roller in rolling contact with the cam and a pushing portion facing a top end of the valve stem, and supported on the rocker shaft for rocking movement; and a removable shim for adjusting tappet clearance disposed between the pushing portion of the rocker arm and the top end of the valve stem, wherein the rocker arm is slidable between a first position in which the pushing portion is aligned with the shim and a second position laterally offset from the first position, and wherein the rocker arm is held in the first position through a spring.

2. The valve drive system for a four-stroke engine of claim 1, wherein the rocker arm has a boss through which the rocker shaft passes and a roller support portion for supporting the roller, the roller support portion extending from the boss toward the top end of the valve stem, and the pushing portion of the rocker arm is located opposite to the roller support portion with the boss therebetween.

3. The valve drive system for a four-stroke engine of claim 2, wherein the boss of the rocker arm is pressed against the cylinder head through the spring when the pushing portion of the rocker arm is held in the first position.

4. The valve drive system for a four-stroke engine of claim 1, wherein the pushing portion is laterally offset from the shim when the rocker arm is in the second position.

5. The valve drive system for a four-stroke engine of claim 1, wherein the rocker arm is slidable between the first and second positions during operation.

6. A valve drive system for a four-stroke engine, comprising:

a cylinder head;

at least one intake and at least one exhaust valve supported by the cylinder head disposed on sides of cylinder bore center line;

a camshaft disposed between a valve stem of the intake valve and a valve stem of the exhaust valve and having adjacent intake and exhaust cams;

first and second rocker arms disposed parallel to each other and arranged along an axial direction of the camshaft;

the first rocker arm being supported on a first rocker shaft for rocking movement and having at a first end a roller in rolling contact with the intake cam and at a second end a pushing portion facing a top end of a valve stem of the intake valve;

the second rocker arm supported on a second rocker shaft for rocking movement and having at one end a roller in rolling contact with the exhaust cam and at the other end a pushing portion facing the top end of the valve stem of the exhaust valve; and removable shims for adjusting tappet clearance disposed between the pushing portion of the first rocker arm and the top end of the valve stem of the intake valve and between the pushing portion of the second rocker arm and the top end of the valve stem of the exhaust valve, respectively, wherein the first and second rocker arms are slidable in the axial direction of the first and second rocker shafts between first positions at which the pushing portions engage the shims and second positions at which the pushing portions are disengaged from the shims, respectively, and held in the first positions through coil springs.

7. The valve drive system for a four-stroke engine of claim 6, wherein the roller of the first rocker arm and the roller of the second rocker arm are apart from each other in the axial direction of the first and second rocker shafts when the first and second rocker arms are held in the first positions, and approach each other when the first or the second rocker arm is slid to the second positions.

8. The valve drive system for a four-stroke engine of claim 7, wherein the coil spring holding the first rocker arm in the first position is mounted on the first rocker shaft and the coil spring holding the second rocker arm in the first position is mounted on the second rocker shaft, and the roller of the first rocker arm faces the coil spring on the second rocker shaft when the first rocker arm is held in the first position and the roller of the second rocker arm faces the coil spring on the first rocker shaft when the second rocker arm is held in the first position.

9. The valve drive system for a four-stroke engine of claim 6, wherein the first rocker arm has a boss through which the first rocker shaft passes for siding movement and the second rocker arm has a boss through which the second rocker shaft passes for sliding movement, the boss of the first rocker arm including a cutout configured to prevent interference with the second rocker arm when the first rocker arm or the second rocker arm is slid to the second position, and the boss of the second rocker arm including a cutout configured to prevent interference with the first rocker arm when the first rocker arm or the second rocker arm is slid to the second position.

10. The valve drive system for a four-stroke engine of claim 6, wherein the first rocker arm has a roller support portion supporting the roller and protruded toward the second rocker shaft and the second rocker arm has a roller support portion supporting the roller and protruded toward the first rocker shaft, the roller support portion of the first rocker arm being formed with a relief portion configured to prevent interference with the second rocker arm when the first rocker arm or the second rocker arm is slid to the second position, and the roller support portion of the second rocker arm is formed with a relief portion configured to prevent interference with the first rocker arm when the first rocker arm or the second rocker arm is slid to the second position.

11. A valve drive system for a four-stroke engine, comprising:

a cylinder head having an external wall defining a valve drive chamber, and a support wall protruded from the bottom of the valve drive chamber and facing the external wall;

an intake valve and an exhaust valve supported by the cylinder head and disposed on different sides of a cylinder bore center line;

a camshaft extending between the external wall and the support wall, located between a valve stem of the intake valve and a valve stem of the exhaust valve and having adjacent intake and exhaust cams;

first and second rocker shafts extending between the external wall and the support wall and generally parallel to each other;

a first rocker arm supported on the first rocker shaft for rocking movement and having a first end with a roller in rolling contact with the intake cam and a second end with a pushing portion facing a top end of the valve stem of the intake valve;

a second rocker arm supported on the second rocker shaft for rocking movement and having a first end with a roller in rolling contact with the exhaust cam and s second end with a pushing portion facing a top end of the valve stem of the exhaust valve;

removable shims for adjusting tappet clearance disposed between the pushing portion of the first rocker arm and the top end of the valve stem of the intake valve and between the pushing portion of the second rocker arm and the top end of the valve stem of the exhaust valve, respectively; and a reinforcement plate connecting a protruded end of the support wall and the external wall for reinforcing the support wall;

wherein the first and second rocker arms are slidable in the axial direction of the first and second rocker shafts between first positions in which the pushing portions engage the shims and second positions in which the pushing portions are disengaged from the shims, respectively and wherein the reinforcement plate includes a first edge extending between the support wall and the external wall at a position corresponding to the first rocker shaft and a second edge extending between the support wall and the external wall at a position corresponding to the second rocker shaft, and formed, between the first and second edges of the reinforcement plate, with an opening for the first and second rocker arms to be exposed.

12. The valve drive system for a four-stroke engine of claim 9, wherein the first and second rocker arms each have a projection protruded toward the opening of the reinforcement plate, wherein the projection extends in a direction transverse to the sliding direction of the first and second rocker arms.

* * * * *

UNITED STATES PATENT AND TRADEMARK OFFICE

CERTIFICATE OF CORRECTION

PATENT NO. : 6,935,289 B2
APPLICATION NO. : 10/947102
DATED : August 30, 2005
INVENTOR(S) : Yasuyuki Nakahira It is certified that error appears in the above-identified patent and that said Letters Patent is hereby corrected as shown below:

In Column 4, Line 59, please delete “horiztonally” and insert --horizontally--

In Column 9, Line 27, please delete “provide” and insert --provided--

In Column 14, Line 20, in Claim 9, please delete “siding” and insert --sliding--

In Column 15, Line 1, in Claim 11, after “cam and”, please delete “s” and insert --a--

Signed and Sealed this

Thirtieth Day of January, 2007

JON W. DUDAS
*Director of the United States Patent and Trademark Office*